US007186079B2

(12) United States Patent
Suciu et al.

(10) Patent No.: US 7,186,079 B2
(45) Date of Patent: Mar. 6, 2007

(54) TURBINE ENGINE DISK SPACERS

(75) Inventors: Gabriel L. Suciu, Glastonbury, CT (US); James W. Norris, Lebanon, CT (US)

(73) Assignee: United Technologies Corporation, Hartford, CT (US)

( * ) Notice: Subject to any disclaimer, the term of this patent is extended or adjusted under 35 U.S.C. 154(b) by 174 days.

(21) Appl. No.: 10/985,863

(22) Filed: Nov. 10, 2004

(65) Prior Publication Data

US 2006/0099070 A1 May 11, 2006

(51) Int. Cl.
*F01D 5/06* (2006.01)

(52) U.S. Cl. ..... 415/199.5; 416/198 A; 416/244 A

(58) Field of Classification Search ..... 415/199.4, 415/199.5; 416/198 A, 200 A, 244 A, 194
See application file for complete search history.

(56) References Cited

U.S. PATENT DOCUMENTS 6,267,553 B1 * 7/2001 Burge ..... 415/115

* cited by examiner

*Primary Examiner*—Edward K. Look
*Assistant Examiner*—Dwayne J White
(74) *Attorney, Agent, or Firm*—Buchman & LaPointe, P.C.

(57) ABSTRACT

A gas turbine engine rotor stack includes one or more longitudinally outwardly concave spacers. Outboard surfaces of the spacers may be in close facing proximity to inboard tips of vane airfoils. The spacers may provide a longitudinal compression force that increases with rotational speed.

23 Claims, 3 Drawing Sheets

TURBINE ENGINE DISK SPACERS

BACKGROUND OF THE INVENTION

The invention relates to gas turbine engines. More particularly, the invention relates to gas turbine engines having center-tie rotor stacks.

A gas turbine engine typically includes one or more rotor stacks associated with one or more sections of the engine. A rotor stack may include several longitudinally spaced apart blade-carrying disks of successive stages of the section. A stator structure may include circumferential stages of vanes longitudinally interspersed with the rotor disks. The rotor disks are secured to each other against relative rotation and the rotor stack is secured against rotation relative to other components on its common spool (e.g., the low and high speed/pressure spools of the engine).

Numerous systems have been used to tie rotor disks together. In an exemplary center-tie system, the disks are held longitudinally spaced from each other by sleeve-like spacers. The spacers may be unitarily formed with one or both adjacent disks. However, some spacers are often separate from at least one of the adjacent pair of disks and may engage that disk via an interference fit and/or a keying arrangement. The interference fit or keying arrangement may require the maintenance of a longitudinal compressive force across the disk stack so as to maintain the engagement. The compressive force may be obtained by securing opposite ends of the stack to a central shaft passing within the stack. The stack may be mounted to the shaft with a longitudinal precompression force so that a tensile force of equal magnitude is transmitted through the portion of the shaft within the stack.

Alternate configurations involve the use of an array of circumferentially-spaced tie rods extending through web portions of the rotor disks to tie the disks together. In such systems, the associated spool may lack a shaft portion passing within the rotor. Rather, separate shaft segments may extend longitudinally outward from one or both ends of the rotor stack.

Desired improvements in efficiency and output have greatly driven developments in turbine engine configurations. Efficiency may include both performance efficiency and manufacturing efficiency.

U.S. patent applications Ser. No. 10/825,255 and Ser. No. 10/825,256 of Suciu and Norris (hereafter the Suciu et al. applications, disclosures of which are incorporated by reference herein as if set forth at length) disclose engines having one or more outwardly concave interdisk spacers. With the rotor rotating, a centrifugal action may maintain longitudinal rotor compression and engagement between a spacer and at least one of the adjacent disks.

SUMMARY OF THE INVENTION

One aspect of the invention involves a turbine engine having a rotor with a number of disks. Each disk extends radially from an inner aperture to an outer periphery. Each of a number of stages of blades is borne by an associated one of the disks. A number of spacers each extend between an adjacent pair of the disks. A central shaft carries the disks and spacers to rotate about an axis with the disks and spacers. The engine includes a stator having a number of stages of vanes. The spacers may include at least a first spacer having a longitudinal cross-section. The longitudinal cross-section may have a first portion being essentially outwardly concave in a static condition. Stages of vanes may include at least a first stage of vanes having inboard vane tips in facing proximity to an outer surface of the first spacer at the first portion thereof.

In various implementations, the inboard tips of the first stage of vanes may be longitudinally convex. In the stationary condition, the inboard tips of the first stage of vanes may be within an exemplary 1 or 2 cm of an outboard surface of the first spacer along the first portion and 2 or 3 cm of a mean of the first spacer along the first portion. In the stationary condition, the first portion may have a longitudinal radius of curvature of 5–100 cm and facing portions of the tips may have a convex longitudinal radius of curvature of 5–100 cm, but greater in magnitude than the first portion longitudinal radius of curvature.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
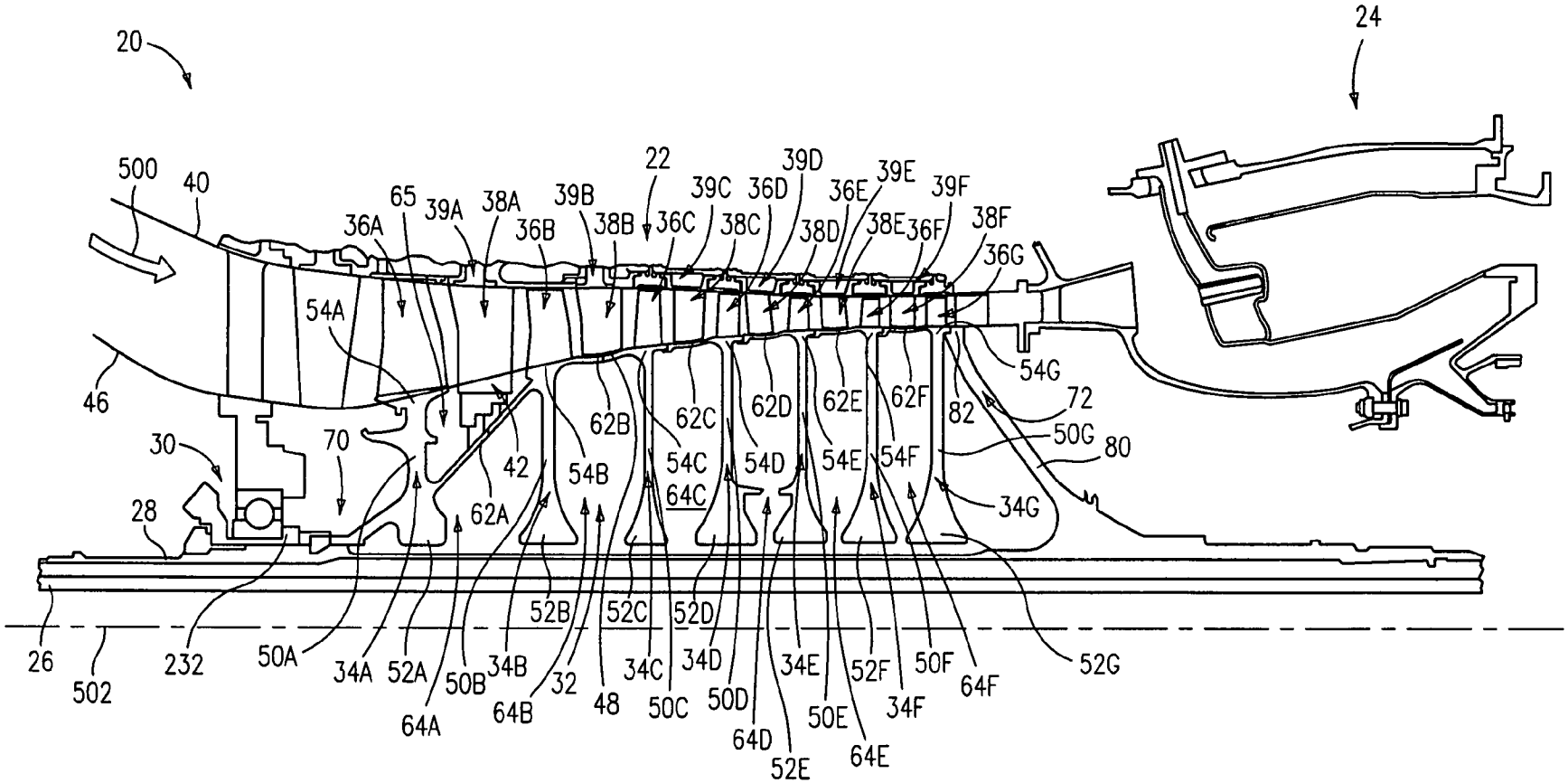
FIG. 1 is a partial longitudinal sectional view of a gas turbine engine.

FIG. 1 shows a gas turbine engine 20 having a high speed/pressure compressor (HPC) section 22 receiving air moving along a core flowpath 500 from a low speed/pressure compressor (LPC) section (not shown) and delivering the air to a combustor section 24. High and low speed/pressure turbine sections (HPT, LPT—not shown) are downstream of the combustor along the core flowpath. The engine may further include a transmission-driven fan (not shown) and an augmentor (not shown) among other systems or features.

The engine 20 includes low and high speed shafts 26 and 28 mounted for rotation about an engine central longitudinal axis or centerline 502 relative to an engine stationary structure via several bearing systems 30. Each shaft 26 and 28 may be an assembly, either fully or partially integrated (e.g., via welding). The low speed shaft carries LPC and LPT rotors and their blades to form a low speed spool. The high speed shaft 28 carries the HPC and HPT rotors and their blades to form a high speed spool. FIG. 1 shows an HPC rotor stack 32 mounted to the high speed shaft 28. The exemplary rotor stack 32 includes, from fore to aft and upstream to downstream, seven blade disks 34A–34G carrying an associated stage of blades 36A–36G. Between each pair of adjacent blade stages, an associated stage of vanes 38A–38F is located along the core flowpath 500. The vanes have airfoils extending radially inward from roots at outboard platforms 39A–39F formed as portions of a core flowpath outer wall 40. The first (#1) vane stage airfoils extend inward to inboard platforms 42 forming portions of a core flowpath inboard wall 46. As is discussed in further detail below, in distinction to the exemplary embodiment of the Suciu et al. applications, the airfoils of the subsequent vane stages extend to inboard airfoil tips 48.

In the exemplary embodiment, each of the disks has a generally annular web 50A–50G extending radially outward from an inboard annular protuberance known as a "bore" 52A–52G to an outboard peripheral portion (blade platform bands) 54A–54G. The bores 52A–52G encircle central apertures of the disks through which a portion 56 of the high speed shaft 28 freely passes with clearance. The blades may be unitarily formed with the peripheral portions 54A–54G (e.g., as a single piece with continuous microstructure), non-unitarily integrally formed (e.g., via welding so as to only be destructively removable), or non-destructively removably mounted to the peripheral portions via mounting features (e.g., via fir tree blade roots captured within complementary fir tree channels in the peripheral portions or via dovetail interaction, circumferential slot interaction, and the like).

A series of spacers 62A–62F connect adjacent pairs of the disks 34A–34G. In the exemplary engine, the first spacer 62A may be formed in a generally similar fashion to that of the Suciu et al. applications (e.g., formed as a generally frustoconical sleeve extending between the aft surface of the first disk web 50A and the second disk). In the exemplary rotor stack, relative to that of the Suciu et al. applications, the aft end of the first spacer 62A is shifted slightly radially outward to intersect with the second disk peripheral portion 54B. This outward shift is in conjunction with an outward shift of the remaining spacers, shifting the longitudinal compression path outward and providing airflow differences described below.

The first spacer 62A thus separates an inboard/interior annular interdisk cavity from an outboard/exterior annular interdisk cavity. The latter may accommodate and seal with the platform 42 of the first vane stage. As discussed above, one or more of the remaining spacers (e.g., all the remaining stages in the exemplary rotor stack), however, are shifted radially outward relative to their analogues in the Suciu et al. applications' exemplary rotor stack. The spacer upstream and downstream portions may substantially merge with or connect to the platform bands 54B–54G of the blade stages of the adjacent disks. Thus, the exemplary remaining spacers 62B–62F separate associated inboard/interior annular interdisk cavities 64B–64F from the core flowpath 500 essentially in the absence of outboard/exterior interdisk annular cavities (with a first inboard cavity 64A having an associated outboard cavity 65).

In the exemplary rotor stack, at fore and aft ends 70 and 72, the rotor stack is mounted to the high speed shaft 28 but intermediate (e.g., at the disk bores) is clear of the shaft 28. At the aft end 72, a rear hub 80 (which may be unitarily formed with or integrated with an adjacent portion of the high speed shaft 28) extends radially outward and forward to an annular distal end 82 having an outboard surface and a forward rim surface. The outboard surface is captured against an inboard surface of an aft portion of the platform band 54G of the aft disk 34G. Engagement may be similar to the hub engagement of the Suciu et al. applications.

Figure 2:
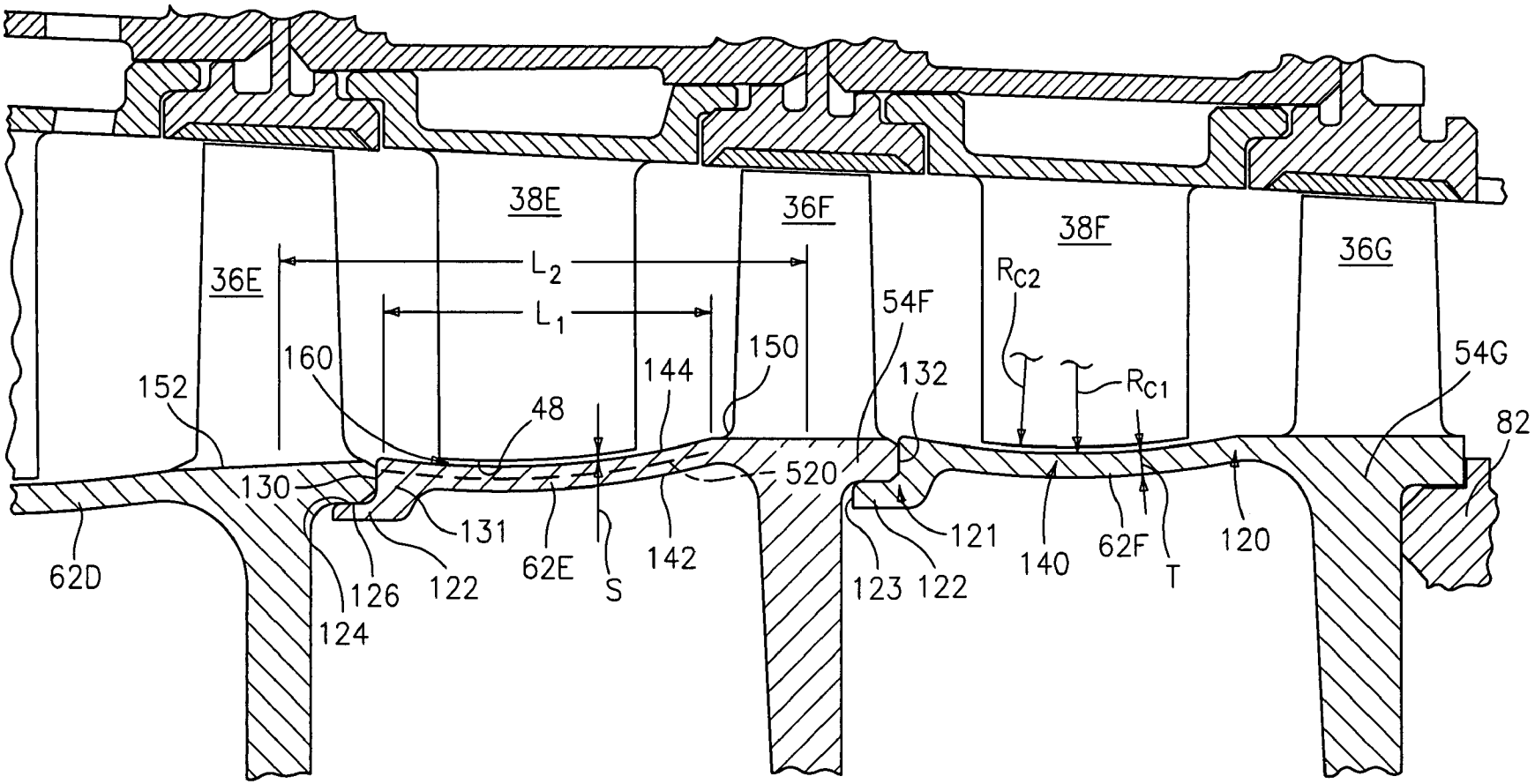
FIG. 2 is a partial longitudinal sectional view of a high pressure compressor rotor stack of the engine of FIG. 1.

As in the Suciu et al. applications, the exemplary first spacer 62A is formed of a fore portion and an aft portion joined at a weld. The fore portion is unitarily formed with a remainder of the first disk 34A and the aft portion is unitarily formed with a remainder of the second disk 34B. The exemplary second spacer 62B is also formed of fore and aft portions joined at a weld and unitarily formed with remaining portions of the adjacent disks 34B and 34C, respectively. However, as in the Suciu et al. applications, the exemplary spacer 62B is of a generally concave-outward arcuate longitudinal cross-section rather than a straight cross-section. In the exemplary engine, the remaining spacers are all essentially single pieces either standing alone or unitarily formed with one of their adjacent disks. FIG. 2 shows the spacers 62D–F as each unitarily formed with the disk immediately aft of such spacer.

FIG. 2 shows the exemplary spacers 62E and 62F as each extending forward from a proximal aft end portion 120 at the forward rim of the immediately aft platform band 54F and 54G to a distal fore end portion 121. The fore end portion 121 has a radially recessed neck 122 having a forward rim surface 123 and an annular outboard surface 124. The outboard surface 124 may be in force fit, snap fit, interfitting, or like relationship with an inboard surface 126 of an aft portion of the platform band 54E and 54F thereahead. A forward surface 130 of a shoulder 131 of the fore end portion 121 abuts a contacting aft rim surface 132 of the platform band thereahead. In the exemplary embodiment, the surface pairs 124 and 126 and 130 and 132 are in frictional engagement (discussed in further detail below). Optionally, one or both surface pairs may be provided with interfitting keying means such as teeth (e.g., gear-like teeth or castellations).

A central portion 140 of each of the spacers 62E and 62F extends between the end portions 120 and 122. At least along this central portion 140, the longitudinal cross-section is concave outward. For example, a median 520 between inboard and outboard surfaces 142 and 144 is concave outward. In the exemplary embodiment, the longitudinal span of this concavity is from proximate (e.g., just aft of) the surface 130 to just ahead of a root portion of the blade leading edge 150 of the blade stage immediately aft of the spacer. Essentially along this span of concavity, the outboard surface 144 is also concave as is the inboard surface 142 (at least aft of the fore portion 121). In the exemplary embodiment, this concave portion of the outboard surface 144 may have a longitudinal span $L_1$ which may be a major portion (e.g., 50–70%) of an associated disk-to-disk span or spacing $L_2$. $L_1$ and $L_2$ may be different for each spacer. Exemplary $L_2$ is 2–15 cm, more narrowly 4–10 cm. The exemplary $L_2$ may be measured at the longitudinal positions of the centers of the chords of the blade roots at the outboard surface 152 of the associated platform band. Exemplary $L_1$ is 1–15 cm, more narrowly 2–8 cm. Exemplary thickness T along the central portion 140 is 2–10 mm, more narrowly 2–5 mm. Accordingly, as distinguished from the exemplary rotor of the Suciu et al. applications, one or more of the spacers has an outboard surface directly and closely facing the inboard tips 48 of the adjacent vanes. A gap 160 may separate the surfaces 144 from the tips 48. Viewed in the circumferential projection (i.e., radial and longitudinal position with angular position collapsed) the tip 48 has a convexity essentially complementary to the concavity of the adjacent portion of the surface 144. Accordingly, the radial span of the gap 160 may be fairly constant along the longitudinal span of the tip (e.g., in particular, at operating speeds). As with the spacers of the Suciu et al. applications, increases in speed may tend to radially expand the spacers, especially in intermediate longitudinal positions so as to partially flatten the spacers. Advantageously, the shapes of the tip 48 and outboard surface 144 are chosen to provide an essentially minimal gap of radial span S at a specific steady state running condition and/or transient condition and/or range of such conditions (see engineering discussion below). FIG. 2 further shows the longitudinal radius of curvature $R_{C1}$ of the outboard surface 144. This radius may be essentially constant over the span of length $L_1$ or may more greatly vary. Exemplary $R_{C1}$ are 5–100 cm, more narrowly 30–60 cm. Similarly, the tip radius of curvature is shown as $R_{C2}$. In the exemplary implementation, due to possible flattening, the magnitude of $R_{C2}$ may be slightly greater than that of $R_{C1}$ in a static condition. For example, it may be approximately 1–10% greater. Exemplary gap spans S are 0–2 cm, more narrowly 0.5–1 cm (with a minimum being desirable), in a static condition, more narrowly, 1–5 mm.

In addition to potential benefits as described in the Suciu et al. applications, use of spacers such as 62E and 62F may have additional advantages. Along the intermediate portions, the radial recessing of the outboard surface 144 (e.g., relative to a frustoconical surface between similar end locations) provides a greater radial span for the core flowpath. The span increase may be local at one or more first locations along at least the first vane stage, with essentially preserved span at one or more second locations. For example, the second locations may be near the leading and trailing (upstream and downstream) extremities of the vane airfoils and along the blade stages while the first locations are centrally adjacent the vane airfoils. This increase in radial span provides an area rule effect, at least partially compensating for reduced flow cross-sectional area caused by the presence of the vane airfoils. This may improve compressor efficiency. Whereas the Suciu et al. applications identified possible reduction in outboard interdisk cavity volume/space, the present spacers may essentially eliminate such cavities and their associated air recirculation losses, heat transfer, and the like. Manufacturing complexity may further be reduced with the absence, for example, of vane inboard platforms. Thus, relative to a frustoconical spacer, the concavity may provide a greater peak radial separation between (a) the spacer outer surface and (b) the root-to-root frustoconical projection between adjacent blade stages. For example, in a reengineering from a baseline configuration with essentially no such separation, the concavity may provide a peak radial separation increase of an exemplary 1–5 mm. This peak separation may be less than an exemplary 2 cm, more narrowly 1 cm, to avoid creating an outboard interdisk cavity producing losses.

Figure 3:
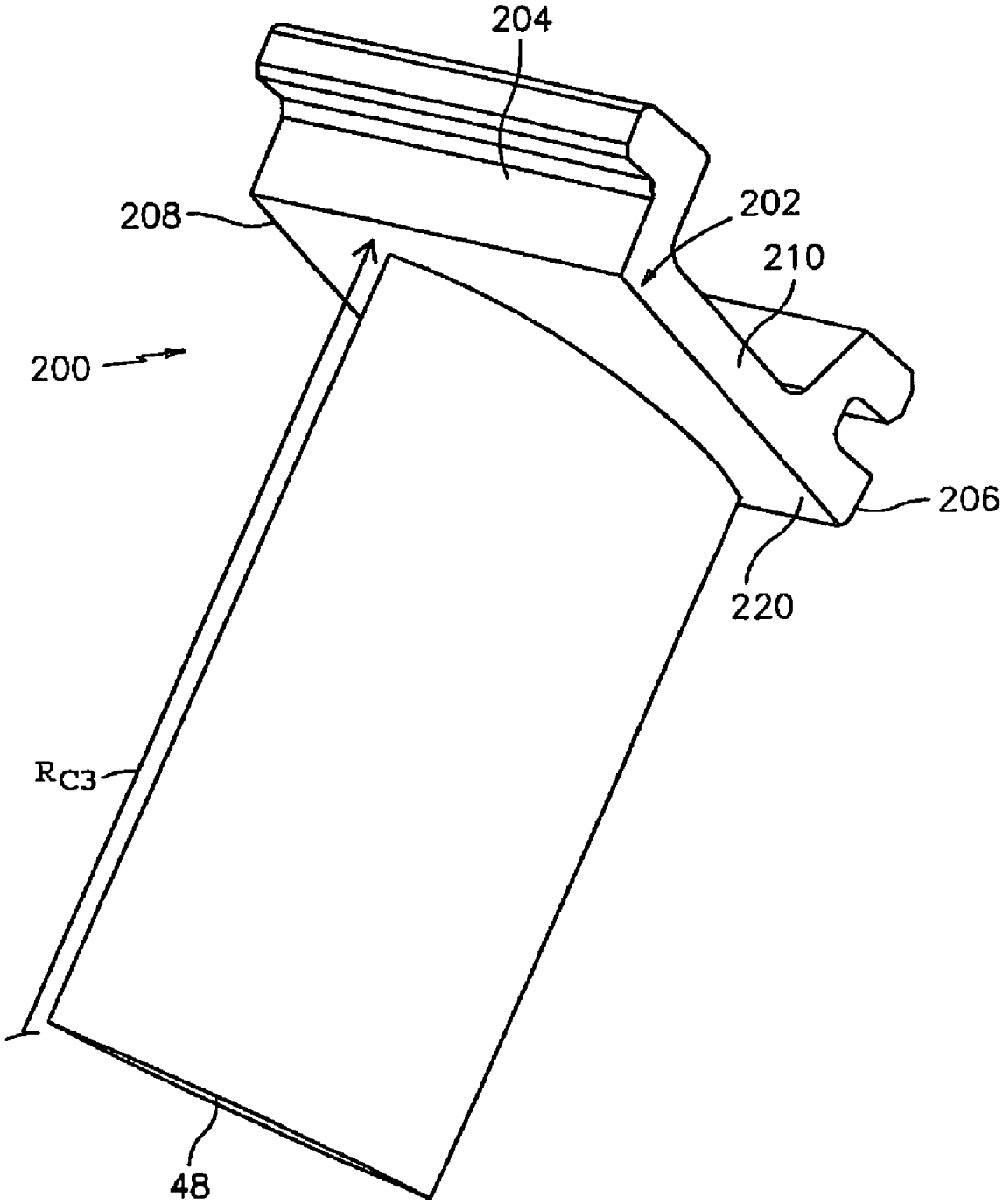
FIG. 3 is a view of a compressor vane of the engine of FIG. 1.

FIG. 3 shows a vane carrying shroud segment 200. The exemplary segment 200 includes an outboard shroud portion 202 extending between fare and aft longitudinal ends 204 and 206 and first and second longitudinally extending circumferential ends 208 and 210. The longitudinal ends may bear engagement features (e.g., lips) for interfitting and sealing with adjacent case components. The circumferential ends may include features for sealing with adjacent ends of the adjacent shroud segments 200 of the subject stage (e.g., feather seal grooves). The shroud has outboard and inboard surfaces. The inboard surface 220 is concave in a first circumferential direction between the circumferential ends 208 and 210 so as to essentially define a radius of curvature $R_{C3}$ from a longitudinal axis of curvature which may be the engine centerline 502.

The foregoing principles may be applied in the reengineering of an existing engine configuration or in an original engineering process. Various engineering techniques may be utilized. These may include simulations and actual hardware testing. The simulations/testing may be performed at static conditions and one or more non-zero speed conditions. The non-zero speed conditions may include one or both of steady-state operation and transient conditions (e.g., accelerations, decelerations, and combinations thereof). The simulation/tests may be performed iteratively, varying parameters such as spacer thickness, spacer curvature or other shape parameters, vane tip curvature or other shape parameters, and static tip-to-spacer separation (which may include varying specific positions for the tip and the spacer). The results of the reengineering may provide the reengineered configuration with one or more differences relative to the initial/baseline configuration. The baseline configuration may have featured similar spacers or different spacers (e.g., frustoconical spacers). The reengineered configuration may involve one or more of eliminating outboard interdisk cavities, eliminating inboard blade platforms and seals (including elimination of sealing teeth on one or more of the spacers), providing the area rule effect, and the like.

One or more embodiments of the present invention have been described. Nevertheless, it will be understood that various modifications may be made without departing from the spirit and scope of the invention. For example, when applied as a reengineering of an existing engine configuration, details of the existing configuration may influence details of any particular implementation. Among other factors, the size of the engine will influence the dimensions associated with any implementation relative to such engine. Accordingly, other embodiments are within the scope of the following claims.

What is claimed is:

1. A turbine engine comprising:

a rotor comprising:

a plurality of disks, each disk extending radially from an inner aperture to an outer periphery;

a plurality of stages of blades, each stage borne by an associated one of said disks;

a plurality of spacers, each spacer between an adjacent pair of said disks; and a central shaft carrying the plurality of disks and the plurality of spacers to rotate about an axis with the plurality of disks and the plurality of spacers; and a stator comprising:

a plurality of stages of vanes, wherein:

said spacers include at least a first spacer having a longitudinal cross-section, said longitudinal cross-section having a first portion being essentially outwardly concave in a static condition; and said stages of vanes include at least a first stage of vanes having inboard vane tips in facing proximity to an outer surface of said first spacer at said first portion.

2. The engine of claim 1 wherein:

the inboard tips of the first stage of vanes are longitudinally convex.

3. The engine of claim 1 wherein:

in a stationary condition, the inboard tips of the first stage of vanes are within 1 cm of an outboard surface of the first spacer along the first portion and 2 cm of a mean of the first spacer along the first portion.

4. The engine of claim 1 wherein:

in a static condition, the first portion has a longitudinal radius of curvature ($R_{C1}$) of 5–100 cm and facing portions of the tips have a convex longitudinal radius of curvature of ($R_{C2}$) 5–50 cm but greater in magnitude than first portion longitudinal radius of curvature ($R_{C1}$).

5. The engine of claim 1 wherein:

said first portion has a longitudinal span ($L_1$) of at least 2.0 cm.

6. The engine of claim 1 wherein:

at least one of said first spacers is essentially unitarily formed with at least a first disk of said adjacent pair of said disks.

7. The engine of claim 1 wherein:

at least one of said first spacers has an end portion essentially interference fit within a portion of a first disk of said adjacent pair of said disks.

8. The engine of claim 1 wherein:

there are no off-center tie members holding the plurality of disks and the plurality of spacers under compression.

9. The engine of claim 1 wherein:

said longitudinal cross-section first portion is essentially outwardly concave in a running condition of a speed of at least 5000 rpm.

10. The engine of claim 1 wherein:

the shaft is a high speed shaft; and the plurality of disks are high speed compressor section disks.

11. A gas turbine engine rotor comprising:

a first disk bearing a first stage of blades;

a second disk bearing a second stage of blades; and a disk spacer comprising:

a first end portion either integrally formed with the first disk or having a surface engaging the first disk;

a second end portion either integrally formed with the second disk or having a surface engaging the second disk; and an essentially annular intermediate portion having a longitudinally outwardly concave outboard surface and an outwardly concave longitudinal sectional median, the outboard surface having a maximum radial separation from a longitudinal root-to-root projection between blades of the first and second stages of no more than 2 cm.

12. The rotor of claim 11 wherein:

said intermediate portion has a longitudinal span of at least 2.0 cm.

13. The rotor of claim 11 wherein:

the first and second end portions, the intermediate portion, the first disk, and the first stage of blades are unitarily-formed as a single piece of a metallic material.

14. The spacer of claim 11 wherein:

the first and second end portions, the intermediate portion, the first disk, and the first stage of blades are integrally-formed from multiple pieces of a metallic material integrated so as to be only destructively separable.

15. The spacer of claim 11 in combination with said first and second disks and wherein:

the spacer first end portion is unitarily-formed with the first disk; and the spacer second end portion is interference fit within a collar portion of said second disk.

16. A turbine engine vane element comprising:

an outboard shroud having outboard and inboard surfaces the inboard surface being concave in a first direction so as to essentially define a longitudinal axis of curvature; and an airfoil element having:

a root at the shroud inboard surface; and a tip, the tip having a circumferentially projected longitudinal convexity along at least a first longitudinal span.

17. The element of claim 16 wherein:

the first longitudinal span is at least 1 cm;

the longitudinal convexity along the first longitudinal span has a radius of curvature of between 5–100 cm.

18. A plurality of elements of claim 16 assembled to form a vane stage.

19. A method for engineering a gas turbine engine, the engine comprising:

a rotor stack comprising:

a plurality of disks, each disk extending radially from an inner aperture to an outer blade-engaging periphery; and a plurality of spacers, each spacer between an adjacent pair of said disks; and a central shaft carrying the rotor stack and having a tie portion within the rotor stack, the method comprising:

for at least a first condition characterized by a first nonzero speed, determining a profile of longitudinal surface concavity of a first one of the spacers;

determining a vane tip convexity and position for a first vane stage effective to provide a desired clearance with the concavity.

20. The method of claim 19 performed as a simulation.

21. The method of claim 19 repeated with a second non-zero speed.

22. The method of claim 19 performed as a reengineering of an engine configuration from an initial configuration to a reengineered configuration wherein:

the reengineered configuration provides a flowpath effective cross-sectional increase at the first vane stage relative to the initial configuration.

23. The method of claim 19 performed as a reengineering of an engine configuration from an initial configuration to a reengineered configuration wherein:

relative to the initial configuration the reengineered configuration provides greater radial span for a core flowpath locally at one or more locations along at least the first vane stage.

* * * * *